US006581673B1

(12) United States Patent
McKibben et al.

(10) Patent No.: US 6,581,673 B1
(45) Date of Patent: Jun. 24, 2003

(54) METHOD FOR CONTROLLING THE FILLING OF A MOLD CAVITY OF A CASTING MACHINE

(75) Inventors: Kenneth D. McKibben, Defiance, OH (US); Daniel D. Minor, Cadillac, MI (US); Robert L. Macheske, Tawas City, MI (US); David B. Good, Chelsea, MI (US); Thomas J. Rozich, Au Gres, MI (US); Mark Salgat, Pinconning, MI (US); Brandon Schnettler, Au Gres, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 09/753,235

(22) Filed: Dec. 29, 2000

(51) Int. Cl.[7] ..... B22D 46/00; B22D 39/06

(52) U.S. Cl. ..... 164/457; 164/155.2; 164/155.5; 164/155.6; 164/133

(58) Field of Search ..... 164/457, 155.1, 164/155.2, 155.3, 155.4, 155.5, 155.6, 155.7, 119, 120, 133

(56) References Cited

U.S. PATENT DOCUMENTS 3,880,221 A * 4/1975 Balevski et al. ..... 164/55
4,354,545 A 10/1982 Goldhammer
4,499,941 A 2/1985 Goldhammer
4,762,165 A * 8/1988 Ogino et al. ..... 164/457
4,875,518 A 10/1989 Imura et al.
5,205,346 A * 4/1993 Kuhn et al. ..... 164/500
5,215,141 A * 6/1993 Kuhn et al. ..... 164/457
5,217,058 A * 6/1993 Sourlier ..... 164/119
5,385,200 A * 1/1995 Yuki et al. ..... 164/119
5,791,398 A 8/1998 Ono et al.

* cited by examiner

*Primary Examiner*—M. Alexandra Elve
*Assistant Examiner*—Len Tran
(74) *Attorney, Agent, or Firm*—MacMillan, Sobanski & Todd, LLC

(57) ABSTRACT

A method for producing a cast article comprising the steps of: (a)providing a casting apparatus having a mold, a casting chamber containing a molten metal under pressure and a fluid under pressure, the casting apparatus having a first supply port for supplying the molten metal to the casting chamber and a second supply port for supplying the fluid to the casting chamber; (b) supplying the molten metal to the first supply port; (c) supplying the fluid to the second supply port; (d) determining the amount of the molten metal in the casting chamber as a variable V1; (e) determining the amount of the fluid in the casting chamber as a variable V2; (f) determining the amount of humidity in the casting chamber as a variable V3; (g) determining the amount of the fluid entering the casting chamber as a variable V4; (h) determining the pressure of the fluid in the casting chamber as a variable V5; (i) determining the amount of the molten metal needed to produce a cast article in the mold as a variable V6; (j) determining the change in the pressure of the molten metal in the mold as a variable V7; (k) sensing the position of the molten metal with respect to the mold as a variable V8; (l) providing a control panel, wherein the control panel receives a signal representative of the variables V1–V8; and (m) adjusting the supply of one or both of the molten metal or the fluid in response to at least one of the signal representative of the variables V1–V8.

15 Claims, 1 Drawing Sheet

METHOD FOR CONTROLLING THE FILLING OF A MOLD CAVITY OF A CASTING MACHINE

BACKGROUND OF THE INVENTION

This invention relates in general to casting machines and in particular to a method of controlling the filling of a mold cavity of such a casting machine with molten metal.

Pressure pouring of molten metal from a furnace to fill a mold cavity has been used for several decades despite a number of problems. At room temperature, the metals are solid and become fluid when melted with sufficient heat. When the metal becomes a fluid it can become difficult to manage as it begins to assume fluid dynamic characteristics.

It is known to use a low pressure countergravity casting apparatus to cast molten metal into mold. One example of such an apparatus is described in U.S. Pat. No. 5,215,141. Basically, in a low pressure countergravity casting apparatus molten metal is supplied to a reservoir of a casting apparatus by a metal supply furnace. The molten metal is received into a crucible of the casting machine. The molten metal is then transported to a holding chamber through a feed tube placed into the crucible. A mold, typically mounted on the holding chamber, receives the molten metal into a cavity of the mold through holes in the mold.

The basic problem in managing the molten metal has been monitoring and controlling the numerous variables which affect the flow of the molten metal in a cavity molding system. These variables effect, among other things, initiation of the molten metal flow, velocity of the molten metal flow, acceleration of the molten metal flow, stopping the flow of the molten metal, and slowing down the molten metal flow within the system. Much of the problem is the number of variables involved and interactions between them, that will effect this complicated and integrated fluid dynamic system. Some of the difficulty is due to variations in the ability to measure the fluid dynamics within the system. Some of the difficulty is due to the ability to control the dynamics within the system once the measurements have been made. Thus, it would be desirable to provide a process to identify and measure the variables which influence molten metal fluid dynamics and control the flow of molten metal within the cavity molding system which is simple and reliable.

SUMMARY OF THE INVENTION

This invention relates to a method for producing a cast article comprising the steps of: (a) providing a casting apparatus having a mold, a casting chamber containing a molten metal under pressure and a fluid under pressure, the casting apparatus having a first supply port for supplying the molten metal to the casting chamber and a second supply port for supplying the fluid to the casting chamber; (b) supplying the molten metal to the first supply port; (c) supplying the fluid to the second supply port; (d) determining the amount of the molten metal in the casting chamber as a variable V1; (e) determining the amount of the fluid in the casting chamber as a variable V2; (f) determining the amount of humidity in the casting chamber as a variable V3; (g) determining the amount of the fluid entering the casting chamber as a variable V4; (h) determining the pressure of the fluid in the casting chamber as a variable V5; (i) determining the amount of the molten metal needed to produce a cast article in the mold as a variable V6; (j) determining the change in the pressure of the molten metal in the mold as a variable V7; (k) sensing the position of the molten metal with respect to the mold as a variable V8; (l) providing a control panel, wherein the control panel receives a signal representative of the variables V1–V8; and (m) adjusting the supply of one or both of the molten metal or the fluid in response to at least one of the signal representative of the variables V1–V8.

Other advantages of this invention will become apparent to those skilled in the art from the following detailed description of the preferred embodiment, when read in light of the accompanying drawings.

DESCRIPTION OF THE PREFERRED EMBODIMENT

Figure 1:
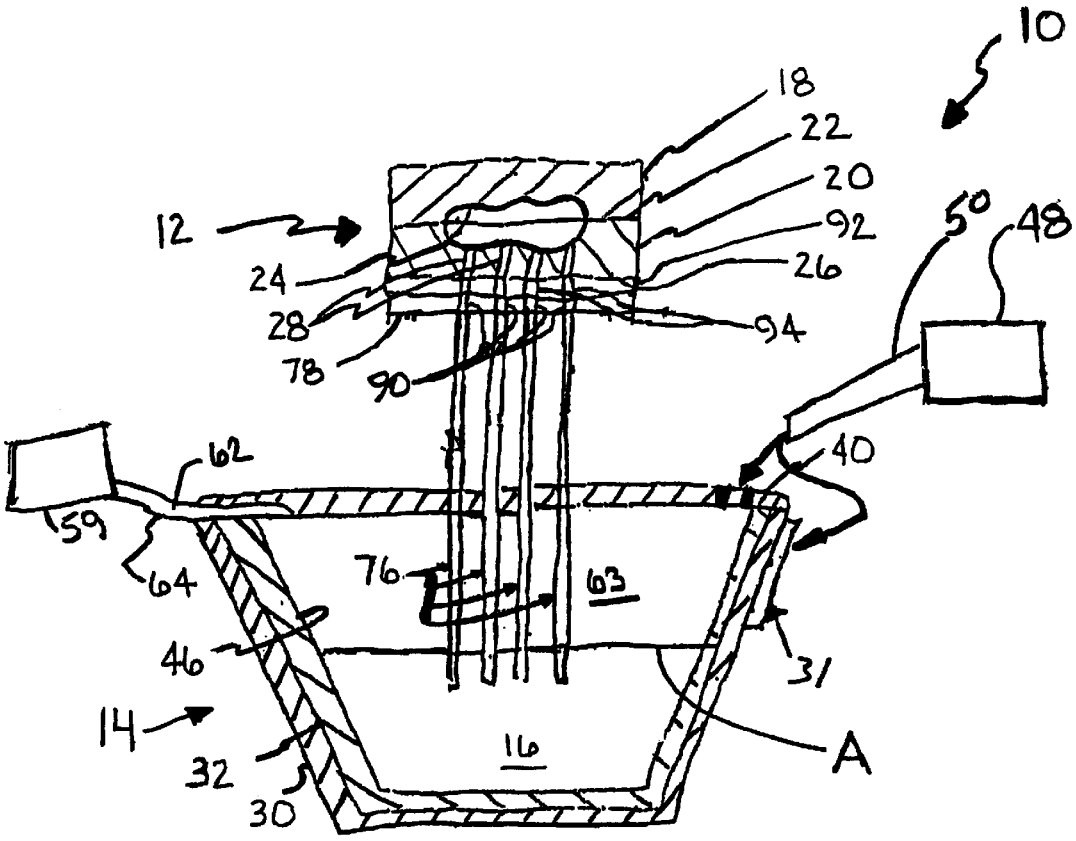
FIG. 1 is a partial cross-sectional elevational view of a low pressure countergravity casting apparatus according to the present invention.

Referring now to FIG. 1, there is illustrated a casting apparatus, indicated generally at 10, in accordance with the present invention. The casting apparatus 10 is illustrated as being a low pressure countergravity casting apparatus. The general structure and operation of the casting apparatus 10 is conventional in the art. Thus, only those portions of the casting apparatus 10 which are necessary for a full understanding of this invention will be explained and illustrated in detail. Although this invention will be described and illustrated in conjunction with the particular casting apparatus 10 disclosed herein, it will be appreciated that this invention may be used in conjunction with other casting apparatuses.

The illustrated casting apparatus 10 includes a mold 12 and a reservoir 14 which defines an internal casting chamber 46. The casting apparatus 10 also has a first supply port 50 for supplying a molten metal 16 to the casting chamber 46, and a second supply port 64 for supplying a fluid 62 to the casting chamber 46. The casting chamber 46 contains the molten metal 16. The molten metal 16 may be molten aluminum or any other suitable metals as desired. The casting chamber 46 also contains the fluid 62, which is preferably under pressure. The fluid may be air, nitrogen gas, or any suitable compressible or non-compressible fluid as desired.

The casting chamber 46 is housed in a reservoir 14. The reservoir 14 is preferably a crucible furnace. The illustrated reservoir 14 includes an outer shell 30 lined with an inner insulating refractory liner 32. The outer shell 30 can be formed from a metal or any other suitable material as desired. The refractory liner 32 is disposed adjacent to and supports the casting chamber 46. In the illustrated embodiment, the reservoir 14 includes a cover 40. The cover 40 is preferably insulated to assist in maintaining the temperature of the molten metal 16 in the casting chamber 46. The cover 40 also preferably provides the casting chamber 46 with an air tight seal for a purpose to be discussed below.

The reservoir 14 includes an access panel or member 31. A suitable access member 31 can be a door. In the illustrated embodiment, the door 31 provides access into the casting chamber 46 for service and repair thereto. In order to best maintain the molten metal 16 and fluid in the casting chamber 46 under pressure, an air tight seal is provided between the door 31 and the casting chamber 46 by suitable means. Alternatively, the door 31 can be used to supply the molten metal 16 from the supply furnace 48 to the casting chamber 46.

The casting chamber 46 is operatively coupled to a metal supply furnace 48, preferably by the first supply port 50. The illustrated first supply port 50 is a trough. The first supply port 50 is preferably insulated to prevent heat loss from the molten metal 16 being supplied by the metal supply furnace 48 to the casting chamber 46. The molten metal 16 is preferably maintained at a substantially consistent level in the casting chamber 46. To accomplish this, the fluid 62 defines an enclosed fluid space 63 provided between the molten metal 16 and the cover 40 overlying the chamber 46. In the illustrated embodiment, a line A is provided to illustrate the respective levels of the molten metal 16 and the fluid 62 in the casting chamber 46. The second supply port 64 is operatively couples a fluid supply 59 to the casting chamber 46.

The mold 12 of the casting apparatus 10 is preferably situated above the reservoir 14. The mold 12 is constructed from conventional foundry mold materials and according to conventional practices in the art. The illustrated mold 12 includes an upper mold half or cope 18 which is joined to a lower mold half or drag 20 along a parting line 22. The upper mold half 18 and the lower mold half 20 define a mold cavity 24 between them. A suitable metal die or other type of die (not shown), can also be used instead of the mold 12 to provide the mold cavity 24. The molten metal 16 is supplied to the mold 12 as described herein to produce a cast article (not shown) in the mold cavity 24. It should be understood that the cast article is preferably about the same shape and about the same contour as the mold cavity 24.

Extending upwardly from a bottom side 26 of the mold 12 is a plurality of inlet feed gates 28 which are operative to establish a fluid communication between the mold cavity 24 and the bottom side 26 of the mold 12. The inlet feed gates 28 of the mold 12 are supplied with the molten metal 15 from the casting chamber 46 through associated feed tubes 76. The illustrated feed tubes 76 extend generally vertical from the casting chamber 46 of the casting apparatus 10 through the cover 40 thereof. The feed tubes 76 are preferably heated or insulated to assist in maintaining the temperature of the molten metal 16 to a desired temperature range.

The mold 12 is supported above the crucible furnace 14 by a suitable member 78. The member 78 is preferably fabricated of refractory material and has a plurality of distribution holes 90 therethrough. The distribution holes 92 preferably correspond in number, arrangement and approximate size to the plurality of bottom feed gates 28 of the mold 12 and in registry therewith for establishing fluid communication between the casting chamber 46 and the mold cavity 24. The particular size, number and arrangement of the feed gates 28 and holes 90 are largely dependent on the configuration of the mold cavity 24 and are selected so as to deliver and distribute the molten metal 16 directly into the cavity 24. A refractory orifice gasket or plate 92 is provided between the mold 12 and the member 78 and is formed with similarly registered small openings 94 therethrough and seals the mold 12 against leakage.

To move the molten metal 16 from the casting chamber 46 into the mold 12, a controlled amount of the fluid 62 is supplied through the second supply port 64 into the casting chamber 46 which in turn causes the molten metal 16 to move upwardly through the feed tubes 76 and feed gates 28 and into the mold 12. The fluid 62 is preferably supplied under pressure. The level of the molten metal 16 in the cavity 24 is proportional to the level of the molten metal 16 in the casting chamber 46, the amount of pressure being exerted on the molten metal 16 in the casting chamber 46, and the density of the molten metal 16. It should be understood that by controlling the amount of pressure in the casting chamber 46, the rate at which molten metal 16 is supplied to the mold 12 can be controlled.

The flow of the molten metal 16 into the cavity 24 of the mold 12, can be influenced by a number of variables or factors. Eight of such variables are denoted as V1–V8 and are defined as follows: V1—pressure loss in the casting chamber 46; V2—variable fluid volume in the casting chamber 46 as the molten metal 16 level in the casting chamber 46 changes; V3—the air volume change in the casting chamber 46 due to change in temperature; V4—inaccurate measurement of the volume of the fluid 62 that is entering the casting chamber 46; V5—inaccurate measurement of the pressure in the casting chamber 46; V6—additional or change in volume of the mold cavity 24; V7—pressure drops due to the motion of the molten metal 16 through the feed tubes or mold; V8—variable vessel PSI when the mold cavity 24 begins to fill with the molten metal 16. It should be understood that identifying, determining, measuring, eliminating, or controlling these variables can result in a more precise control of the flow of the molten metal 16, and thereby produce a more desirable cast article.

For example, according to variable V1, fluid or air may leak or otherwise escape from the casting chamber 46. The leak results in a pressure loss from the casting chamber 46. Determining the amount, or changes in the amount, of the molten metal in the casting chamber can be used to determine the pressure loss from the casting chamber 46. Accounting for the pressure loss in the casting process can allow for a more desirable cast article being produced in the mold 12.

As the cast article is produced in the mold 12 from the molten metal 16, the amount of molten metal 16 in the casting chamber 46 decreases. Changes in the fluid volume in the casting chamber 46 occur as the molten metal 16 level in the casting chamber 46 changes. Thus, according to variable V2, accounting for the decrease in the amount of molten metal 16 in the casting chamber 46 as each cast article is produced in the mold 12 can allow for a more desirable cast article being produced.

The fluid 62 in the casting chamber 46 expands as it increases in temperature. Likewise, a variable amount of moisture, or humidity, in the fluid contribute to changes in the pressure in the casting chamber 46. Therefore, according to variable V3, accounting for the fluid expansion and the amount of moisture in the casting chamber 46 can allow for a more desirable cast article being produced.

According to variable V4, inaccurate measurement of the volume of the fluid 62 entering the casting chamber 46 through the second supply port 64 may also effect the quality of cast article being produced. In the event of supplying excess fluid 62 to the casting chamber 46, a corresponding pressure increase will result in the casting chamber 46. Likewise when supplying insufficient fluid 62 to the casting chamber 46 a corresponding pressure drop will result in the casting chamber 46. In either case, the amount of pressure available to move the molten metal 16 upwardly to the mold 12 can be other than optimal.

In order to produce a desirable cast article, the pressure in the casting chamber 46 should be determined precisely. By accounting for variable V5, any inaccuracies in the pressure determination can be accounted for and thus produce a more desirable castable article. For example, if it is determined that the amount of pressure in the casting chamber 46 is actually less than anticipated, additional fluid 62 can be provided via the second supply port 64 to increase the pressure in the casting chamber 46. Likewise, if it is determined that the amount of pressure in the casting chamber 46 is actually greater than anticipated. less fluid 62 can be provided via the second supply port 64 to increase the pressure in the casting chamber 46.

During the casting process, the mold cavity 24 can become larger or smaller. This can occur as the mold cavity 24 erodes, making the mold cavity 24 larger than anticipated. Also, undesirable deposits, such as from the molten metal 16, may form on the surface of the mold cavity 24. These deposits make the mold cavity 24 smaller than anticipated. Accordingly, the cast articles being produced in the mold cavity 24 can be slightly larger or smaller as more or less molten metal 16 is used. By accounting for variable V6, any inaccuracies in the determination of the size of the mold cavity 24 and variations in the amount of molten metal 16 being used to create the cast article can be accounted for. This can allow for the production of a more desirable cast article.

Pressure in the casting chamber 46 can change as the molten metal 16 moves through the feed tube 76. The pressure can be changed by filters (not shown) located between the feed tube 76 and the mold cavity 24 or by the characteristics of the mold 12 itself. By measuring the pressure changes in the casting chamber 46 due to movement of the molten metal 16, variable V7 can be accounted for in producing the cast article.

Knowing the precise position of the molten metal 16 with respect to the mold 12 and the casting chamber 46 can be useful in determining the optimal amount of the fluid or the molten metal 16 that is required to move the molten metal 16 into the mold 12 and fill the mold cavity 24. Thus, according to variable V8, sensing the position of the molten metal 16 with respect to the mold 12 can be accounted for in the production of a more desirable cast article.

Figure 2:
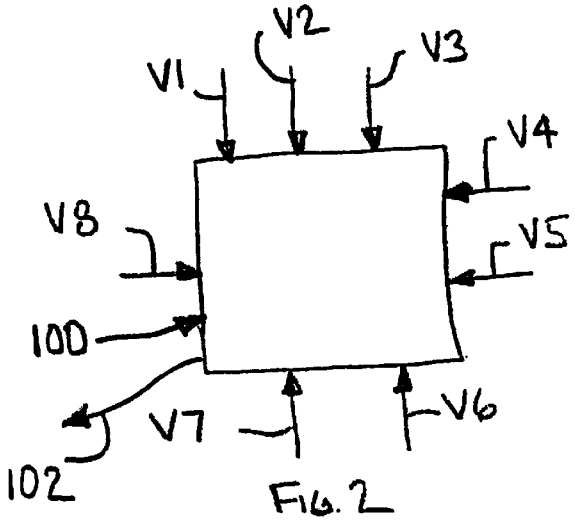
FIG. 2 is a schematic diagram of a control panel for use with the present invention.

A determination of one or more of each of the variables V1–V8 produces a corresponding signal representative of that variable. A control panel 100 shown in FIG. 2 is provided to receive the signals (denoted as V1–V8) and to send a signal (denoted by line 102) to adjust the supply of one or both of the molten metal 16 or the fluid 62 in order to optimize the flow of the molten metal 16 through the casting apparatus 10. The cast article produced by the casting apparatus 10 can be a vehicle wheel or any other suitable object.

In accordance with the provisions of the patent statutes, the principle and mode of operation of this invention have been described and illustrated in its preferred embodiments. However, it must be understood that the invention may be practiced otherwise than as specifically explained and illustrated without departing from the scope or spirit of the attached claims.

What is claimed is:

1. A countergravity casting method for producing a cast article comprising the steps of:

(a) providing a casting apparatus having a mold, a substantially air tight casting chamber in communication with the mold, a first supply port for supplying a molten metal to the casting chamber, and a second supply port for supplying a pressurized fluid to the casting chamber;

(b) supplying the molten metal to the first supply port to cause the molten metal to be supplied to the casting chamber;

(c) supplying the pressurized fluid to the second supply port to cause the molten metal to be supplied from the casting chamber to the mold;

(d) determining the amount of the molten metal in the casting chamber as a variable V1;

(e) determining the amount of the fluid in the casting chamber as a variable V2;

(f) determining the amount of humidity in the casting chamber as a variable V3;

(g) determining the amount of the fluid entering the casting chamber as a variable V4;

(h) determining the pressure of the fluid in the casting chamber as a variable V5;

(i) determining the amount of the molten metal needed to produce a cast article in the mold as a variable V6;

(j) determining the change in the pressure of the molten metal in the casting chamber as a variable V7;

(k) sensing the position of the molten metal with respect to the mold as a variable V8;

(l) providing a control panel which receives a signal representative of the variables V1–V8; and (m) adjusting the supply of one or both of the molten metal or the pressurized fluid in response to at least one of the signals representative of the variables V1–V8.

2. The method according to claim 1 wherein the step (m) includes adjusting the supply of one or both of the molten metal or the fluid in response to the signals representative of the variables V1 and V2.

3. The method according to claim 1 wherein the step (m) includes adjusting. the supply of one or both of the molten metal or the fluid in response to the signals representative of the variables V1–V3.

4. The method according to claim 1 wherein the step (m) includes adjusting the supply of one or both of the molten metal or the fluid in response to the signals representative of the variables V1–V4.

5. The method according to claim 1 wherein the step (m) includes adjusting the supply of one or both of the molten metal or the fluid in response to the signals representative of the variables V1–V5.

6. The method according to claim 1 wherein the step (m) includes adjusting the supply of one or both of the molten metal or the fluid in response to the signals representative of the variables V1–V6.

7. The method according to claim 1 wherein the step (m) includes adjusting the supply of one or both of the molten metal or the fluid in response to the signals representative of the variables V1–V7.

8. The method according to claim 1 wherein the step (m) includes adjusting the supply of one or both of the molten metal or the fluid in response to the signals representative of the variables V1–V8.

9. The method according to claim 1 wherein the step (m) includes adjusting the supply of the molten metal in response to at least one of the signal(s) representative of the variables V1–V8.

10. The method according to claim 1 wherein the step (m) includes adjusting the supply of the fluid in response to at least one of the signal(s) representative of the variables V1–V8.

11. A countergravity casting method for producing a cast article comprising the steps of:

(a) providing a casting apparatus having a mold, a substantially air tight casting chamber in communication with the mold, a first supply port for supplying a molten metal to the casting chamber, and a second supply port for supplying a pressurized fluid to the casting chamber;

(b) supplying the molten metal to the first supply port to cause the molten metal to be supplied to the casting chamber;

(c) supplying the pressurized fluid to the second supply port to cause the molten metal to be supplied from the casting chamber to the mold;

(d) determining the amount of the molten metal in the casting chamber as a variable V1;

(e) determining the amount of humidity in the casting chamber as a variable V3;

(f) sensing the position of the molten metal with respect to the mold as a variable V8;

(g) providing a control panel which receives a signal representative of the variables V1, V3 and V8; and (h) adjusting the supply of one or both of the molten metal or the pressurized fluid in response to at least one of the signals representative of the variables V1, V3 and V8.

12. The method according to claim 11 wherein the step (g) includes adjusting the supply of one or both of the molten metal or the fluid in response to the signals representative of the variables V1 and V3.

13. The method according to claim 11 wherein the step (g) includes adjusting the supply of one or both of the molten metal or the fluid in response to the signals representative of the variables V1 and V8.

14. The method according to claim 11 wherein the step (g) includes adjusting the supply of one or both of the molten metal or the fluid in response to the signals representative of the variables V3 and V8.

15. The method according to claim 11 wherein the step (g) includes adjusting the supply of one or both of the molten metal or the fluid in response to the signals representative of the variables V1, V3 and V8.

* * * * *